US006645349B1

(12) United States Patent
Koivukunnas et al.

(10) Patent No.: US 6,645,349 B1
(45) Date of Patent: Nov. 11, 2003

(54) METHOD AND DEVICE FOR CONDITIONING OF A ROLL, IN PARTICULAR OF A ROLL IN A PAPER MACHINE OR IN A PAPER FINISHING DEVICE

(75) Inventors: Pekka Koivukunnas, Järvenpää (FI); Tapio Mäenpää, Helsinki (FI)

(73) Assignee: Valmet Corporation, Helsinki (FI)

( * ) Notice: Subject to any disclaimer, the term of this patent is extended or adjusted under 35 U.S.C. 154(b) by 0 days.

(21) Appl. No.: 09/600,806

(22) PCT Filed: Jan. 19, 1999

(86) PCT No.: PCT/FI99/00030

§ 371 (c)(1),
(2), (4) Date: Sep. 14, 2000

(87) PCT Pub. No.: WO99/36616

PCT Pub. Date: Jul. 22, 1999

(30) Foreign Application Priority Data

Jan. 20, 1998 (FI) ..... 980109
Sep. 22, 1998 (FI) ..... 982039

(51) Int. Cl.[7] ..... D21G 1/00

(52) U.S. Cl. ..... 162/272; 162/199; 162/198; 162/263

(58) Field of Search ..... 162/198, 199, 162/272, 276, 277, 278, 279, 263, 252; 101/425; 15/256.51, 256.53; 451/5, 9; 33/555.1; 700/127, 128, 129

(56) References Cited

U.S. PATENT DOCUMENTS

| | | | | | |
|---|---|---|---|---|---|
| 3,775,241 | A | * | 11/1973 | Justus et al. | 162/199 |
| 4,106,333 | A | | 8/1978 | Salje et al. | 73/105 |
| 4,516,212 | A | * | 5/1985 | Nagashima | 364/475 |
| 4,841,675 | A | * | 6/1989 | Perneczky | 51/67 |
| 4,852,209 | A | | 8/1989 | Svenka et al. | 15/308 |
| 4,953,252 | A | | 9/1990 | Akisawa | 15/308 |
| 5,033,373 | A | | 7/1991 | Brendel et al. | 100/38 |
| 5,131,324 | A | | 7/1992 | Lassila et al. | 100/153 |
| 5,177,903 | A | | 1/1993 | Maier | 51/165.77 |
| 5,331,178 | A | * | 7/1994 | Fukuda et al. | 250/571 |
| 5,371,975 | A | * | 12/1994 | Lundmark | 451/9 |
| 5,394,653 | A | | 3/1995 | Maier | 451/303 |

(List continued on next page.)

FOREIGN PATENT DOCUMENTS

| | | | |
|---|---|---|---|
| DE | 2138289 | 2/1973 | G01B/5/28 |
| DE | 4340700 | 6/1995 | G01M/7/02 |
| EP | 0676501 | 10/1995 | D21F/3/08 |
| EP | 0775778 | 5/1998 | D21G/1/00 |
| FI | 77490 | 11/1988 | D21F/3/08 |
| FI | 90103 | 12/1993 | D21G/3/02 |
| FI | 971488 | 1/1997 | D21F/3/08 |
| GB | 1357900 | 6/1974 | G01B/7/34 |

*Primary Examiner*—Peter Chin
*Assistant Examiner*—Eric Hug
(74) *Attorney, Agent, or Firm*—Steinberg & Raskin, P.C.

(57) ABSTRACT

The invention concerns a method for conditioning of a roll, in particular of a roll (10) in a paper machine or in a paper finishing device. In the method the face/coating on the roll of the paper machine is cleaned and/or ground. In the method, the cleanliness and/or condition of the roll (10) is/are measured continuously during operation and, based on the measurement results, the roll face/coating is cleaned and/or ground so that the roll (10) remains constantly in good condition and the level of quality of the paper remains at the desired level. The invention also concerns a device for conditioning of a roll, in particular of a roll in a paper machine and/or in a paper finishing device, which device (20) comprises means for cleaning and/or grinding the roll. The device (20) consist of an assembly (20) of devices which comprises a cleaning/conditioning unit (24, 23, 29), a control unit (33), and measurement units (30, 31, 32), and the device operates continuously and can be operated during running.

24 Claims, 4 Drawing Sheets

U.S. PATENT DOCUMENTS 5,439,548 A * 8/1995 Kalwar ..... 156/350
5,562,525 A * 10/1996 Mori et al. ..... 451/5
5,597,449 A 1/1997 Vestola et al. ..... 162/199
5,655,444 A 8/1997 Kayser et al. ..... 100/334
5,797,325 A 8/1998 Ebina et al. ..... 101/425
5,842,418 A 12/1998 Corrado et al. ..... 101/425
5,945,595 A * 8/1999 Mori et al. ..... 73/105
5,964,960 A * 10/1999 Boeck ..... 134/34

* cited by examiner

FIG. 1A
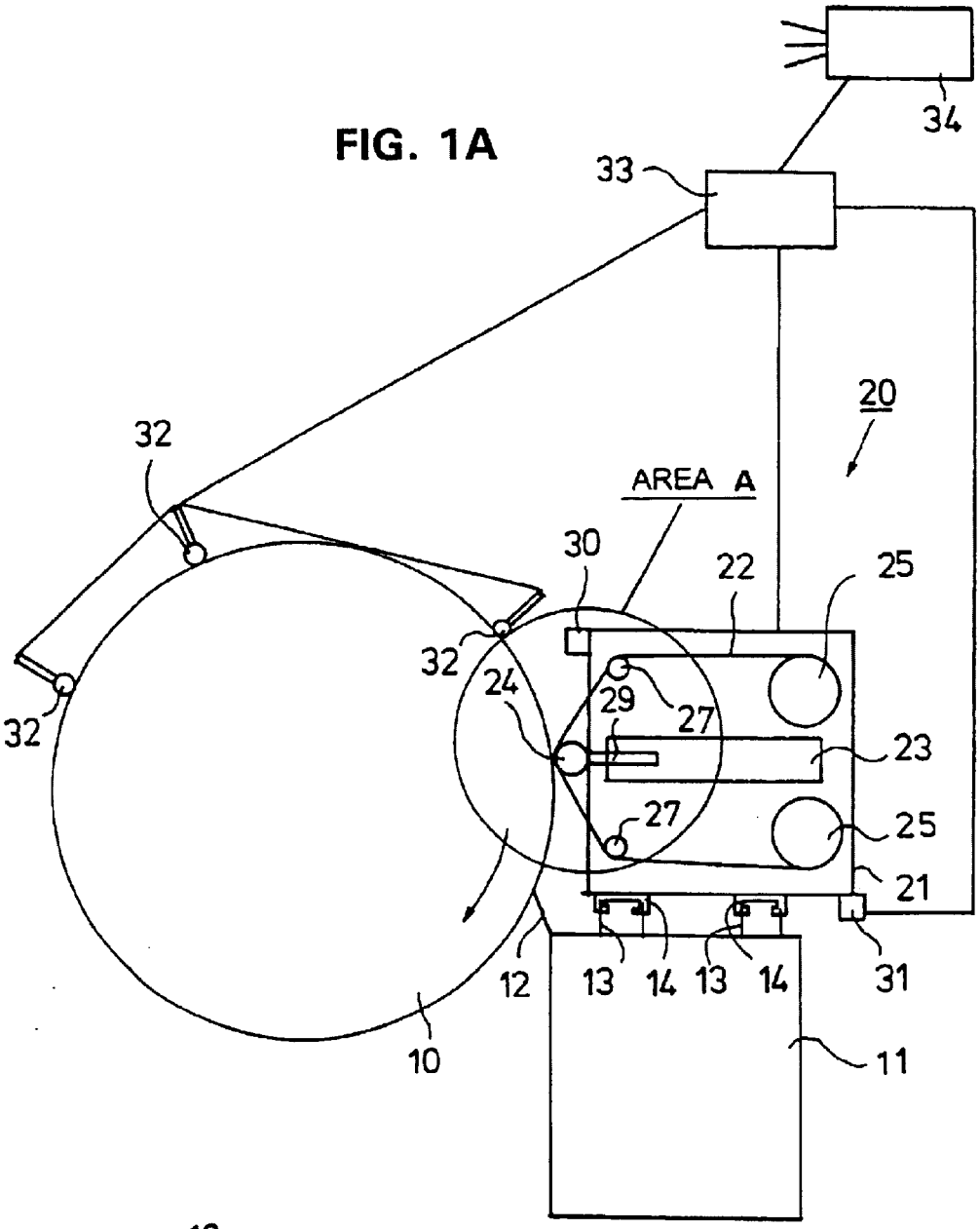
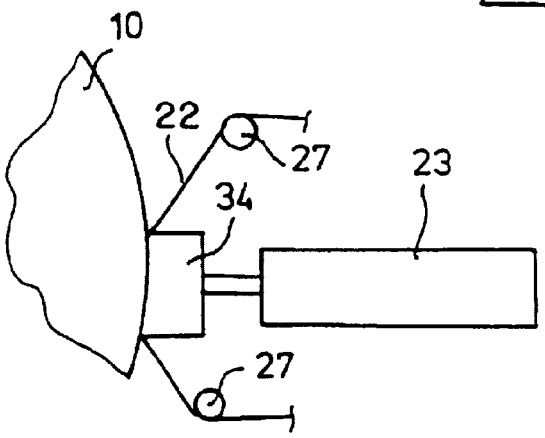
FIG. 1B

METHOD AND DEVICE FOR CONDITIONING OF A ROLL, IN PARTICULAR OF A ROLL IN A PAPER MACHINE OR IN A PAPER FINISHING DEVICE

FIELD OF THE INVENTION

The invention concerns a method for conditioning of a roll, in particular of a roll in a paper machine or in a paper finishing device, in which method the condition of the face/coating on the roll is monitored and the face/coating on the roll is cleaned and/or ground.

The invention also concerns a device for conditioning of a roll, in particular of a roll in a paper machine and/or in a paper finishing device, which device comprises means for monitoring the condition of the face/coating on the roll and for cleaning and/or grinding the face/coating.

BACKGROUND OF THE INVENTION

As is known from the prior art, in paper machines and in finishing devices of paper machines, the rolls in said machines and devices are contaminated, worn and/or damaged during operation, which has the consequence that the properties of the paper that is produced deteriorate. This is why the rolls must be cleaned and/or conditioned from time to time, in which connection the machine has to be stopped for the time of cleaning/conditioning. In some cases, the condition of a roll has deteriorated to such an extent that the roll must be replaced, which is detrimental in view of the production and may result in a standstill in the production in the paper machine.

An unevenness in the roll face, irrespective of whether it arises from contamination or consists of some other exceptional feature in the geometry of the roll face, causes alterations in the profile of the paper web. One particular problem related to coated rolls are the so-called hot spots, i.e. local heating of the roll. Hot spots arise in roll faces at an elevated zone arising from particles of contamination or equivalent, as a result of deformation arising from a higher surface pressure in the nips between the rolls, which results in formation of hysteresis heat, which causes damage to the roll coating at this location. This effect is made particularly problematic by the fact that the progress of a hot spot is rapid, and a hot spot is difficult to locate. Causes of disturbance include debris coming from outside or fibres or other contaminations coming along with the paper web.

One method of monitoring the face of a roll is visual examination of the roll, for example, by means of a camera. By means of detectors that have been fitted stationarily in view of monitoring of the condition of the roll bearings, it is possible to detect disturbance that affects the balance of the roll and also a hot spot that has developed sufficiently far. On the contrary, minor unevenness, single particles of contamination or a hot spot that is in its initial stage in the roll face cannot be detected by means of such methods.

In some prior-art solutions, the operator observes the roll face and, when he notices a hot spot, he eliminates the hot spot manually by means of a doctor. Currently, when recycled stock is used abundantly, adhesive constituents (stickies) contained in said stock increase the problem of hot spots. At present, paper machines are often connected with on-line coating, and the coating material (paste) must be dried before calendering. Sometimes the paste remains moist, which also causes increased hot spot problems.

The coating on a roll can also be damaged by what is called barring, in which case the roll face is subjected to formation of damage in the coating, which causes vibration. Barring means that on the roll face, in the axial direction of the roll, wear traces arise, which extend across the entire length of the roll and which resemble a certain sort of grooves. The process of formation of barring has not been established fully, but it is one explanation that minor variations in the thickness of the web in the longitudinal direction of the web produce wear of the roll face when said variations are repeated at suitable intervals.

The face of a roll is also worn during operation, in which connection the roughness of the face is increased and the quality of the paper deteriorates, in which case the roll must be removed for grinding and replaced by a replacement roll. For example, the thermo rolls used in the prior-art calenders are worn and become rough, in which case the linear load in the calender must be increased, which again reduces the bulk, and/or it is necessary to raise the calendering temperature, which reduces the bulk and also increases the consumption of energy.

A roll can also be worn unevenly, in which case the profile of the paper varies, and the roll must be removed for grinding and replaced by a replacement roll.

In the manufacture of paper, by means of a what is called calender, which is placed after the paper machine or which is connected directly with the paper machine, the face of the paper is processed to make the paper suitable in particular for printing machines so that the paper is passed through one or several roll nips. In the prior art currently applied, the roll nip in the calender is, as a rule, formed between a soft roll and a hard roll. The hard roll is made of metal, for example steel, and its face has been polished. The soft roll has been coated with an elastic synthetic material, for example some polymer. The paper web is passed into said nip formed by the pair of rolls, in which nip the smooth face of the hard roll smooths and glazes the paper web, and the elastic face of the soft roll provides the paper web with uniform density. If it is desirable to glaze both faces of the paper, the machine must have two pairs of rolls, so that one hard roll glazes one face of the paper and the other hard roll the other face. The hard rolls are usually heated rolls. In the U.S. Pat. No. 5,033,373 and in the published EP Patent Application 0,728,867 A2, calenders made of pairs of rolls are described, and the U.S. Pat. No. 5,131,324 describes a group of rolls in which there are one soft roll and two hard rolls. A soft roll differs from a hard roll in the respect that, since the face of a soft roll is made of some resilient material, for example polymers, particular attention must be paid to its servicing. A disturbing factor that is in its initial stage ought to be detected and located immediately in order that it could be eliminated directly. For example, in a two-nip calender, in which there is one variable-crown roll and one thermo roll in each nip, two replacement rolls must be kept constantly on stock, which involves costs. On the other hand, renewed coating of coated rolls is very expensive, so that a coating that has been spoiled, for example, because of a hot spot is quite expensive.

Since, as is well known, the condition of rolls has been monitored mainly by the operator manually in view of contamination, deterioration of condition, damage, for example hot spots, and in view of similar problems as well as by monitoring the quality of the paper, a number of replacement rolls have been necessary, and it has been necessary to renew coatings, which is expensive. Further, the standstills required by cleaning and conditioning operations have increased the costs.

With the use of various doctors, it is possible to clean the face of a roll during operation. Grinding can also be applied.

With respect to the prior art related to the present invention, reference can be made, for example, to the FI Patent Applications 971488 and 941620 as well as to the U.S. Pat. No. 5,394,653 and to the EP Patent Application 0,359,304. In the FI Patent Application 971488, a band grinding device for rolls and a method for the control of the band grinding device in the grinding of faces of variable-crown rolls are described. The device and the method known from said published patent application are, however, meant to be used after the roll has already been removed from the machine to a grinding machine, and it is an advantage of said invention that the time taken by the grinding has become shorter. In the FI Patent Application 941620, a method and an equipment in conditioning of the coating on a roll are described, wherein the face of the roll is conditioned periodically and on the site without removing the roll. This arrangement does, however, not involve monitoring in order to establish the condition of the roll, and the solution suggested in said patent application involves providing of a doctor of the roll to be conditioned with a separate grinding device, which is fitted in the actuators of the doctor and brought into contact with the face to be ground by means of the doctor.

This device permits grinding of the roll in its site of operation. The U.S. Pat. No. 5,394,653 and the published EP Patent Application 0,359,304 describe traversing superfinishing devices for grinding of rolls, but said devices do not involve monitoring of the condition of the roll.

OBJECTS AND SUMMARY OF THE INVENTION

Thus, the object of the present invention is to suggest a method and a device by whose means the roll in a paper machine can be kept constantly in good condition, in which case the level of quality of the paper remains at the desired level.

It is a particular object of the invention to suggest an arrangement which is carried out continuously and during operation and which does not require a standstill for conditioning and/or cleaning of the roll.

One object of the present invention is to provide a method by whose means any divergencies in the roll face can be detected at a stage as early as possible.

The method in accordance with the invention is mainly characterized in that, in the method, the cleanliness and/or condition of the roll is/are measured continuously during operation and, based on the measurement results, the roll face/coating is cleaned and/or ground so that the roll remains constantly in good condition and the level of quality of the paper remains at the desired level.

On the other hand, the device in accordance with the invention is mainly characterized in that the device consists of an assembly of devices which comprises a cleaning/conditioning unit, a control unit, and measurement units, and that the device operates continuously and can be operated during running.

In accordance with the invention, certain parameters are measured, after which the grinding/cleaning device is controlled based on the measurement results, and the roll is cleaned/ground into good condition. In accordance with the invention, the cleanliness and the condition of the roll are measure d by means of a suitable method of measurement continuously on-line. At the same tire, it is possible to measure the shape and the circularity of the form of the roll, for example, by means of contact-free laser detectors. Further, in accordance with the invention, in the control, if desired, data on the thickness profile of the paper and possible other measurement data representing the quality of the paper as well as measurement data illustrating the operation of different parts of the paper machine are taken into account.

The device in accordance with the invention favorably consists of a traversing multiple-function head, by whose means the cleaning/conditioning of the roll is carried out, and of a control unit. The traversing beam that is used for the multiple-function head is most appropriately a prefabricated commercially available beam, and the multiple-function head preferably consists of a grinding unit, of a vibration-measurement unit that contacts the roll face, and of a unit for measurement of the shape and the circularity of the form of the roll.

The device in accordance with the invention can be fitted on the holder of a doctor, and by means of the measurement device, damage in the face is searched for and, if desired, it is possible to monitor the shape of the roll. As an auxiliary device for the device in accordance with the present invention, it is possible to use a traversing superfinishing device of the sort described in said U.S. Pat. No. 5,394,653 and in said published EP Patent Application 0,359,304.

In accordance with the present invention, the same grinding unit is used for cleaning and grinding of the roll face. When the roll is just contaminated, grinding takes place with a low grinding pressure, in which connection the face of the roll is not worn to a substantial extent, but the impurities are removed. If an error of shape has been worn into the coating, the grinding pressure is varied automatically so that it is higher at a thicker portion of the roll and is reduced at a thinner portion, in which way the error of shape can be corrected. Likewise, the grinding pressure can be varied during one revolution of the roll, in which way an error in the circularity can be corrected. By means of the device in accordance with the invention, it is possible to remove material, for example, at a hot spot, in which way its progress can be stopped. The grinding parameters for the grinding unit are selected automatically on the basis of the measured signals and of the signals received from the control system of the paper machine Besides the grinding pressure, it is also possible to regulate the traversing speed and the relative speed between the grinding element and the face to be ground.

As is well known, beams in paper machines involve errors of shape, which affect the roll grinding device. In connection with the device in accordance with the present invention, it is possible to provide devices of measurement, by whose means the shape of the roll and possible hanging down are measured, and said deficiencies are corrected by means of programming so that, even if a beam were curved or hanging, possibly slanting or bent, the grinding of the roll is, however, carried out so that a straight roll is obtained. For example, a laser beam can be used for measurement of a bending of a first order in the roll.

In the method in accordance with the invention errors in the linear shape of the traversing beam and bending of the beam, etc. are compensated for by means of programming. It is possible to use, for example, a laser beam parallel to the roll in the calender as a reference line, in which case the mechanical constructions do not have to be massive or manufactured with unreasonable precision. Thus, the system in accordance with the present invention compensates for its own faults on the basis of the control.

Rolls are not always fully circular, which causes problems. In accordance with the present invention, for example, onto the blade of a doctor, one or several acceleration transducers can be attached to an arm, in which case it is possible to measure the shape of the roll with very high precision.

In accordance with the present invention, it is possible to use moistening or chemicals in order to enhance the detaching of impurities and the grinding. Any excessive moisture is removed by means of blowing, suction, or a combination of same.

When the condition of the roll is maintained in accordance with the invention, the desired quality of the paper is achieved constantly, and no standstills are needed for replacement of the roll, the requirement of replacement rolls is reduced, and the service life of the roll coating becomes longer. If desired, the present invention can also be applied during a standstill without removing the roll.

According to a preferred embodiment of the invention, the face of the roll is measured by means of a laser detector, and data concerning the thickness of the paper are collected both in the machine direction and in the cross direction of the machine, and this same device, on which the measurement devices are fitted, is also used for cleaning and grinding the roll based on the measurement data. In the device, a grinding band is replaced by a cleaning band, for example a very fine diamond band or some other band specifically developed for cleaning, and impurities are ground from the roll face at a low pressure, in which case the measure of the roll is not changed practically at all, when it has been noticed that the roll requires cleaning. When it is noticed that the roll has an error of shape in the cross direction of the machine, i.e. in the longitudinal direction of the roll, the roll is ground intensively so that the error of shape can be corrected. If "angular shape" is noticed in the roll, the grinding is varied during one revolution, in which case the errors on the roll can be corrected during one revolution. The device in accordance with the invention is operated during running.

In the arrangement in accordance with the invention, when it has been noticed, for example, by means of measurement that a hot spot has been formed, the hot spot is located by means of the measurement devices, and material is removed by means of the grinding head of the device exclusively from the area of the hot spot on the roll down to the plane of the roll face or, if necessary, even so that a recess is formed below said plane. The device in accordance with the invention operates continuously, and the measurement and cleaning/grinding are carried out during running. This is very important, because hot spots are formed very quickly, and there are just a few minutes of time to take action.

Thus, the arrangement in accordance with the present invention is intelligent, it examines and acts on the basis of the results of its examination, and any defects, vibrations and equivalent in the roll can be corrected. When the operation takes place in accordance with the invention, the roll is constantly in good condition, in which case the level of quality of the paper remains constantly at the desired level. The invention is very well suitable for use in connection with polymer rolls and thermo rolls. When the device in accordance with the present invention is used, the desired quality is achieved constantly with a minimum of work, and possible standstill times related to cleaning/conditioning of the roll remain considerably shorter than when arrangements known from the prior art are used.

In the method in accordance with the present invention, preferably an accurate displacement-measurement technology is used for detecting of the disturbance points. In the method, the vibration detector(s) has/have been fitted on a member that is in contact with the roll face. When the roll revolves, the point of discontinuity arrives at the location of the detector at regular intervals and produces a signal, and even minor unevenness in the roll face, i.e. changes in the geometry of the circumference of the roll, can be detected immediately.

It is an important advantage of a preferred arrangement of measurement employed in connection with the present invention that, to carry out the invention, it is possible to employ fully commercially available technology, and the necessary components have been produced in series, in which case application of the method is highly economical, as compared with other methods.

In the publication EP 0,728,867 A2 mentioned above, it is stated that the average roughness of the face of a soft roll does not exceed the value $R_a$ 0.5 $\mu$m, which gives an idea of how smooth the faces of soft rolls can be machined. In experiments that have been carried out, it has been noticed that by means of both embodiments of the invention, which will be described later, it is possible to notice defects of shape in a roll face whose divergence from the roll face is of an order of 1 $\mu$m and even smaller. An equally good result cannot be achieved by means of any other mode of measurement.

Since the method is quick and its resolving power is very good, with mobile detectors this also permits a very short traversing time ($\geqq$30 s). Even small defects and errors of shape can be detected quickly. Since the method is very rapid and accurate, barring of a face that is still at its initial stage can also be detected very early. The basic cause of barring is not yet fully known, but if and when it will be known in the course of time, the beginning of barring can be detected at a very early stage, and the progress of barring can be stopped or barring be eliminated completely by controlling the paper machine or the calendering process.

By means of the advantageous arrangement of measurement equipment in accordance with the present invention, the condition of the face of a roll can be monitored accurately in real time. The equipment comprises a contact member fitted against the face of the roll, on which member a displacement-measurement detector has been fitted, which is connected to a data transfer line in order to transfer the signal produced by the detector along the data transfer line to a recording unit included in the equipment.

BRIEF DESCRIPTION OF THE DRAWINGS

In the following, the invention will be described with reference to the figures in the accompanying drawing, the invention being, however, not supposed to be strictly confined to the details of said illustrations.

FIG. 1A is a schematic illustration of an exemplifying embodiment of the device in accordance with the invention.

FIG. 1B is a schematic illustration of a second embodiment of the area A in the exemplifying embodiment shown in FIG. 1A.

DETAILED DESCRIPTION OF THE INVENTION

Figure 2:
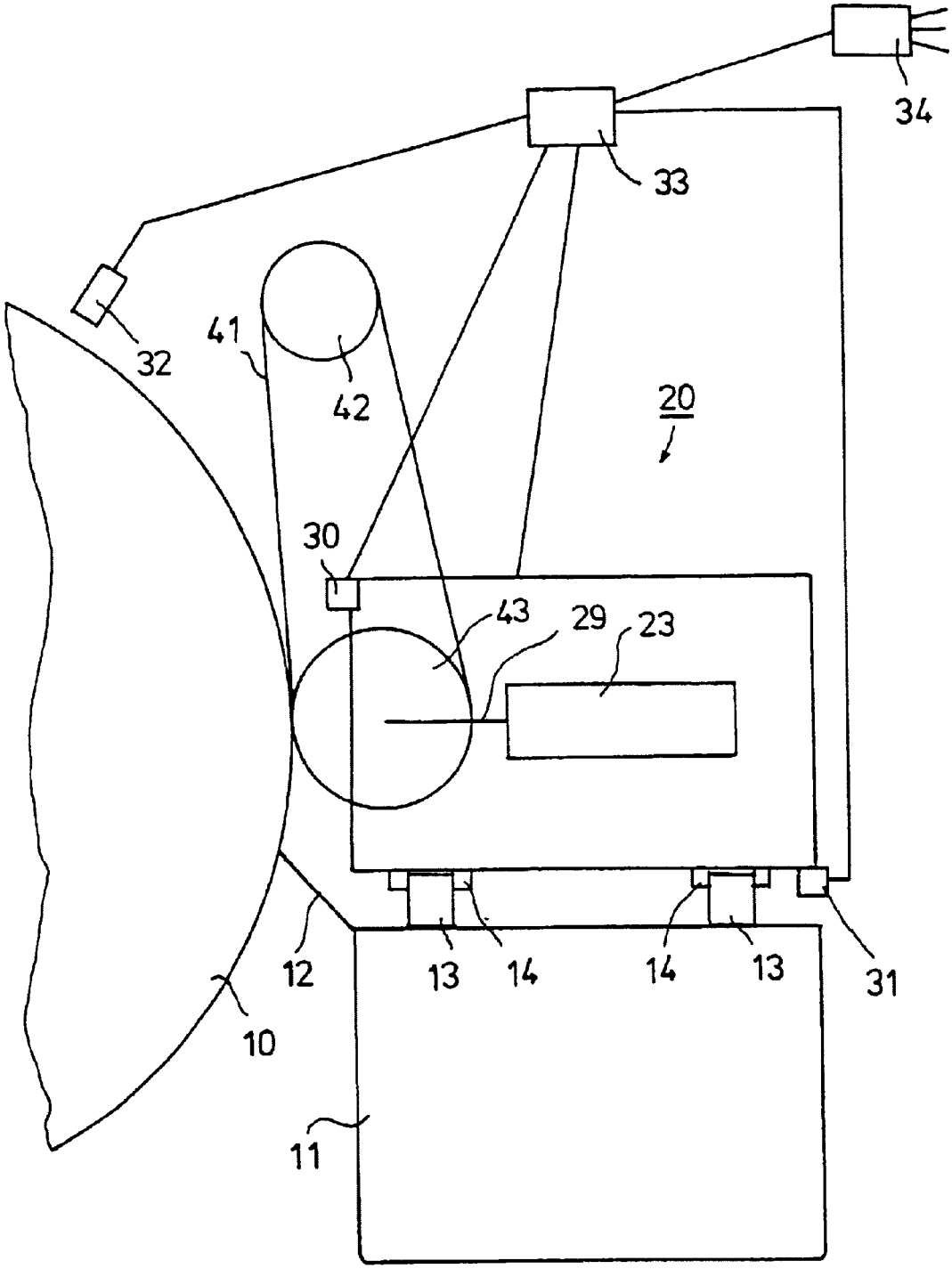
FIG. 2 is a schematic illustration of a second exemplifying embodiment of the device in accordance with the invention.

FIG. 1A is a schematic illustration of a device 20 in accordance with the present invention, preferably a super-finishing device as fitted in connection with the roll 10. The device comprises a cleaning roll 24, by whose means the cleaning and grinding are carried out, and an actuator 23 which operates on the basis of a piezoelectric crystal or a magnetostrictive, e.g., terphenol material. The device 20 has been attached to guides 13,14 on a doctor beam 11, to which the doctor 12 has also been attached.

The device 20 also comprises a measurement device 30, by whose means the roll face is measured and monitored in respect of contamination, wear, and damage in the coating. Favorably, the device 20 also comprises a measurement device 31 for measurement of the linear form of the guide beams 13,14 and of the other constructions of the device 20 and for transmitting the measurement result obtained from said device to the control system 33 of the device 20, which system compensates for possible errors in the linear form and for other errors of shape. In connection with the device 20, measurement devices 32 for measurement of the shape of the roll have also been fitted, the data obtained from said measurement devices being also transmitted to the control system 33 of the device, to which system data are also received from the control system 34 of the paper machine concerning measurements carried out in other parts of the paper machine, as required. A cleaning/grinding band 22 runs over the cleaning roll 24, which band has been fitted to run over guide and drive rolls 25,27. The device 20 in accordance with the invention is connected with a cleaning roll 24, which is provided with an active actuator 23, which is based, for example, on a piezoelectric crystal or on a magnetostrictive material (terphenol) or equivalent, which is controlled electrically.

The beam 11 of the doctor 12 shown in the figure is one possible alternative mode of fastening, but the device in accordance with the invention can also be attached in connection with some other device, in connection with the roll, or it can be provided with a fastening beam of its own.

FIG. 1B is a schematic illustration of a second exemplifying embodiment of the area A in FIG. 1A, in which the cleaning roll 24 has been substituted for by a cleaning shoe 34. In the other respects, the construction of the device is similar to what is illustrated in FIG. 1A.

In the device 20 in accordance with an embodiment of the invention, shown in FIG. 2, the grinding/cleaning band 41 has been connected between two rolls 42,43 as an endless band, and it is controlled by means of an actuator 23 carried into effect by means of a piezoelectric crystal or a magnetostrictive material, and the device has been attached to a doctor beam. In the other respects, the exemplifying embodiment shown in FIG. 2 is similar to that shown in FIG. 1A, and the same reference denotations have been used for corresponding parts.

In the exemplifying embodiments shown in the figures, the device 20 in accordance with the invention has been attached in connection with the doctor 12 on the beam 11 on the guides 13, and it is provided, for example, with rails 14 for the device 20. The regulation of pressure is carried out, for example, by means of a pneumatic cylinder 29, and the device 20 can be traversing. By means of the device 20, the face can be finished/cleaned/conditioned in a way in itself known from the prior art, in accordance with the present invention, based on the data provided by the measurement units 30,31,32 of the device 20 while controlled by the control unit 33. The control unit 33 also receives the data concerning the necessary objects from the control system 34 of the paper machine/finishing device.

In accordance with the invention, the device 20 is used for cleaning and grinding of the face of the roll 10. If the roll is just contaminated, grinding is carried out with a low grinding pressure, in which case the face of the roll is not worn, but the impurities are detached. If an error of shape has been worn into the coating, the grinding pressure is varied automatically to a higher level at a thicker portion of the roll 10 and reduced at a thinner portion, whereby the error of shape can be corrected. Likewise, the grinding pressure can be varied during one revolution of the roll 10, in which connection an error in the circularity can be corrected. By means of the device in accordance with the invention, material can be removed, for example, from the area of a hot spot, and the grinding parameters are chosen automatically based on the measured signals and on the signals received from the control system of the paper machine. Besides the grinding pressure, it is also possible to regulate the traversing speed and the relative speed between the grinding element and the face to be ground.

Figure 3:
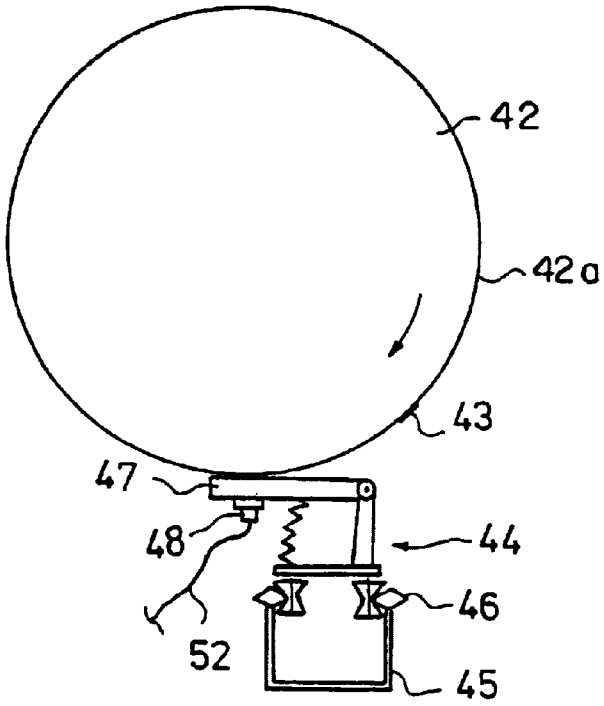
FIG. 3 shows an embodiment of the invention in which the detector has been fitted on a member which traverses in the direction of the face of the roll, being mounted as mobile on a beam parallel to the longitudinal direction of the roll.

In the embodiment shown in FIG. 3, there is a coated roll, for example a soft roll 42 in a calender, and the disturbance point, for example a particle of contamination adhering to the roll face 42*a*, is denoted with the reference numeral 43. The roll revolves constantly. At the side of the roll, parallel to the roll, in the axial direction of the roll, there is the support beam 45 of the traversing device 44, and the traversing device 44 proper moves along the rails 46 of the support beam 45 by means of a drive gear in itself known back and forth from end to end along the roll. The traversing device 44 is provided with a member 47, which is in contact with the roll 41 face and which member has been mounted on the traversing device and pressed by means of a spring load against the roll face so that the member can follow the face of the roll. A vibration detector 48 rigidly attached to the member 47 detects any discontinuity present on the roll face, such as particles of contamination, hot spots that are being formed, or other elevation zones formed on the roll face. This embodiment comprises one detector which traverses across the width of the roll to be monitored. The detector 48 transmits the signal to the recording unit, in which the noise is filtered off, and the data obtained are utilized in the control of a cleaning/conditioning device.

The data are passed to the recording unit from the vibration detector and from the location indicator of the traversing device, in which connection these data can be transferred to the control unit, which controls the correction device that carries out the conditioning of the roll face, such as local cleaning or grinding. The correction device can also be attached to the same traversing device, in which case, when the vibration detector 48 detects a disturbance point 43, the device carries out the necessary operations in this area of the roll. The contact member 47 may consist of a member dragging or rolling along the roll face 42*a*, with which member the vibration detector 48 has been coupled fixedly. The detector 48 can involve a technology in itself known, for example, it can be a prior-art vibration detector or acceleration transducer. It is typical of the detector that it can indicate even small displacements from a reference location, and for detectors of this type it is possible to use the general designation "displacement-measurement detector".

Figure 4:
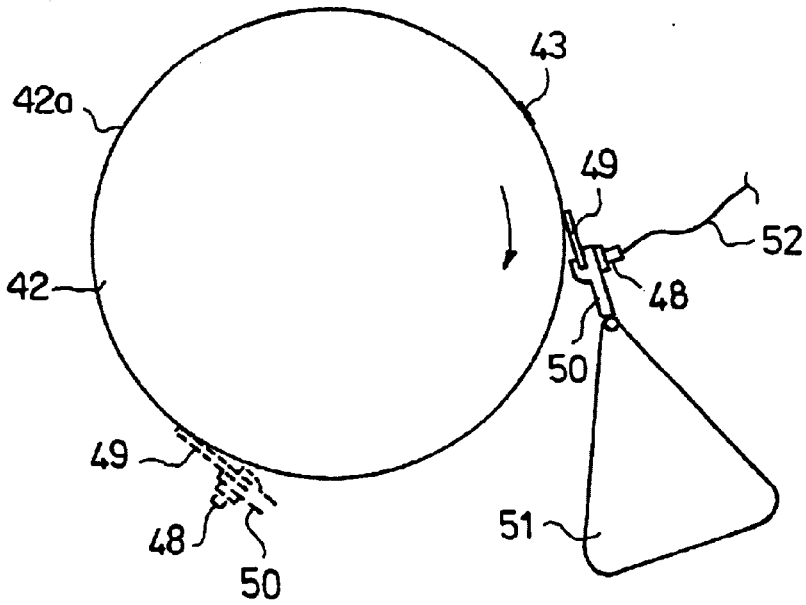
FIG. 4 shows an embodiment of the invention in which one or several detectors have been attached to the holder of a doctor blade which follows the face of the roll.

In the embodiment of the method of measurement illustrated in FIG. 4, one or several vibration detectors 48 has/have been attached to a doctor(s) of the roll. Here a doctor is understood as a thin rib extending from one end of the roll to the other end, one edge of which rib is in contact with the roll at every point, and the function of said doctor is to clean the roll. The blade 49 of the doctor has been attached to a blade holder 50, which is supported by a doctor beam 51, and a number of detectors 48 can be attached, for example, side by side in the axial direction on this blade holder. The blade holder and the blade are functionally equivalent to the member 47 shown in FIG. 3, and they are also pressed with a suitable load (doctoring pressure) against the face 42*a*. The doctor beam 51 comprises means for regulation of the doctoring pressure of the doctor blade, and a possible roll face correction device traversing in the longitudinal direction of the roll can also be attached to said beam. The method operates so that, when the blade 49 of the doctor meets a disturbance point 43 on the face of the roll, this produces a certain vibration in the doctor, which vibration is recorded by the vibration detectors 48 attached to the holder 50 of the doctor. The signals pass to the recording unit, in which the delays arising from the distance of the detectors measured in relation to the disturbance point and the change in amplitude arising from the intensity of the disturbance, as compared with noise, are analyzed, and the disturbance point is located. Based on the data, the control unit controls the doctoring pressure or a separate cleaning and/or grinding device, which eliminates the disturbance factor. Instead of being attached to the blade holder 50, the detector/detectors 48 can also be attached to the top face of the blade 49 itself.

FIG. 4 shows a situation of backward doctoring, in which the running direction of the mantle face of the roll is against the blade 49 edge. Such an arrangement in itself already removes contaminations, and by its means it is possible to detect permanent irregularities which produce constant impacts at a certain location of the blade. The doctor construction can also be arranged as a forward doctor, in which the edge of the blade 49 points at the running direction of the roll face, and this alternative has been illustrated by means of dashed lines. The detectors provided in this doctor construction are capable of detecting all irregularities. It is also possible to provide the same roll both with a forward doctor construction and with a backward doctor construction, each of which constructions is provided with a series of detectors 48.

Figure 5:
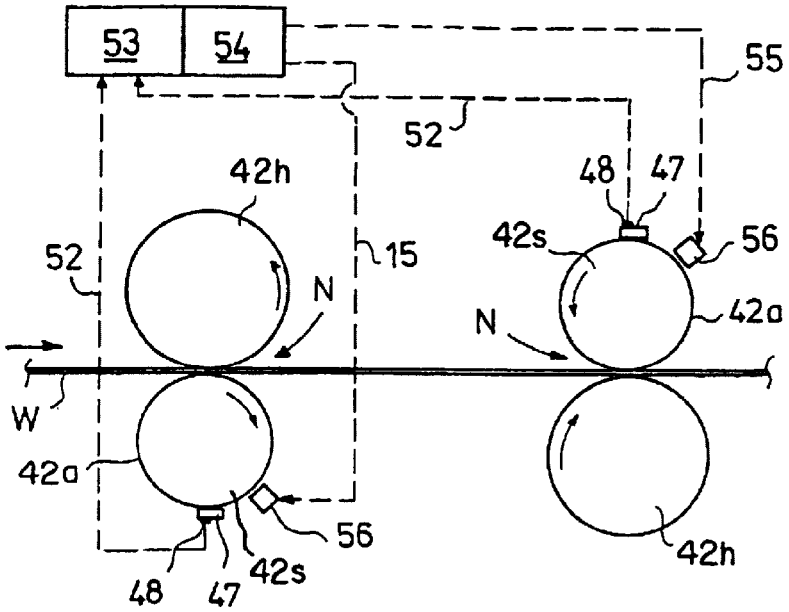
FIG. 5 shows the assembly of one possible calender and the equipment connected with it.

FIG. 5 is a side view of one possible type of a calender and of an equipment installed in its connection for constant monitoring of the condition of a roll face. The calender comprises two pairs of rolls placed one after the other in the running direction of the paper web W, in each of which pairs of rolls there is a calender nip N formed between the rolls, through which nip the web W has been passed. A hard roll is denoted with the reference numeral 42*h* and a soft roll with the numeral 42*s*. In successive pairs of rolls, rolls of the same type are placed at opposite sides of the web W in order that both outer faces of the web W should receive equal processing. Against the faces of the soft rolls 42*s*, contact members 47 have been fitted, each of which is provided with a detector 48 or with a series of detectors 48, and the principle of the contact members can be any of those illustrated in FIGS. 1 and 2. From the detectors 48, data transfer lines 52 have been passed, along which the signals pass to the recording unit 53, which can process the data and present the data in a suitable form, for example in a display device, and possibly store said data as a data base. The recording unit 53 communicates with a control unit 54 through a data transfer line, which control unit can again control the correction devices 56 connected with the calender rolls 41s through data transfer lines 55. The use of the invention is, of course, not confined to the type of calender shown in this figure alone.

Figure 6:
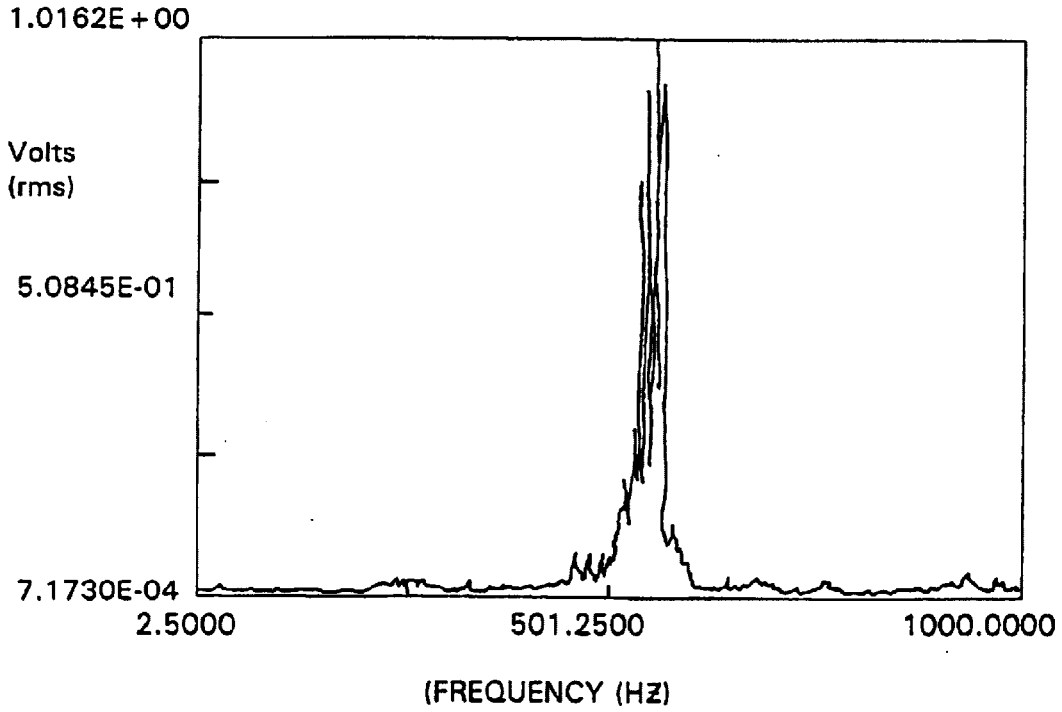
FIG. 6 is an example of one measurement result obtained by means of the method in accordance with the present invention.

FIG. 6 illustrates one signal obtained from a roll face by means of a vibration detector when barring of a soft calender roll is measured by means of the method in accordance with the invention. What is concerned is a signal produced by an error of shape smaller than 1 micrometre, which provides evidence on the accuracy of the method.

The traversing devices with their rails involve prior-art commercially available technology, and so do the vibration detectors. The necessary recording and control units and the actuators required by the control can also be assembled out of fully commercial elements used in data processing and automation. This is why the use of the present method is favourable and economical both in respect of the cost of investment and in respect of the availability of the equipment.

The correction devices can be any prior-art devices whatsoever, or in them it is possible to employ new methods which will be developed later. The correcting device is preferably a device which cleans and/or grinds the roll face. If a disturbance point arises from a material adhering to the face, the cleaning device can apply local addition of a detergent chemical.

It is a further great advantage of the method that the type, colour or temperature of the impurity adhering to the roll face and possibly causing damage to the paper web has no significance for the operability or sensitivity of the method, because the detecting takes place with the principle of contact.

The method can be used in particular for monitoring of the condition of rolls used in the manufacture and processing of paper, for example of calender rolls with soft coatings. The method is also suitable for monitoring of the face of a hard-faced roll in a calender, in particular for detection of particles of contamination, and also for monitoring of other hard rolls that are used in manufacture and processing of paper. As regards the cost of the method, the method is also suitable for use in processes less expensive than papermaking. Such rolls are used, for example, in high-speed printing machines that transfer a paper web or in machines in which a continuous web-like product of any material whatsoever is treated in whose profile no changes are permitted which arise from unevenness of rolls or from particles of contamination adhering to the roll faces.

The signal produced by the detector 48 connected with the member that monitors the quality of a roll face can be processed in a number of ways. Even rolls with very smooth faces and in very good conditions produce a noise of some degree, which must be filtered off. The signals produced by disturbance can be analyzed highly accurately, in which connection the information obtained can provide data on the nature, magnitude and location of the disturbance and on a trend of its development, etc. This information can be passed automatically in the ways described above to members which carry out purposeful correcting operations. At the same time, by means of comparison of the noise, information is also obtained concerning the basic condition of the roll. All the data provided by the detector/detectors 48 can be stored as a data base, and these data can be used when the rolls are passed to overhaul.

For a person skilled in the art, it is also obvious that application of the method is not confined to certain components or to components manufactured by certain manufacturers. Nor is the type of the detector that is used for detecting a disturbance point on the roll a decisive factor, irrespective of whether the disturbance is an elevated zone arising from local heating in the geometry of the roll face, a particle of contamination adhering to the face, or equivalent. The operation of the detector is based on a force applied from the rapidly moving face of the roll to the detector, which force subjects the detector to changes that can be converted to an electric signal, such as acceleration, compression, tension, shear forces, etc. Likewise, the signal is directly proportional to the magnitude of the changes, so that monitoring of the roll face can be carried out with a quantitative principle. One good embodiment of a detector is a piezoelectric crystal, by whose means a sufficiently sensitive detector can be provided.

In connection with the device in accordance with the invention, it is possible to employ a number of different grinding methods and measurement methods known in themselves, for example acceleration transducers, laser meters, and linear detectors.

Above, the invention has been described with reference to some preferred exemplifying embodiments of same only, and the invention is, however, by no means supposed to be confined to the details of said embodiments. Many variations and modifications are possible within the scope of the inventive idea defined in the following patent claims.

What is claimed is:

1. A method for conditioning of a roll (10;41) in a paper machine or in a paper finishing device, comprising the steps of:

monitoring the condition of the face/coating on the roll during operation;

cleaning and/or grinding the face/coating on the roll by means of a traversing cleaning/grinding unit during operation;

continuously measuring the cleanliness and/or condition of the roll (10;41) during operation, wherein said cleaning and/or grinding of the roll face/coating is based on the measurement results, so that the roll (10;41) remains constantly in good condition and the level of quality of the paper remains at the desired level; and controlling the grinding pressure of the cleaning/grinding unit on the measurement results;

wherein, in the method, a polymer-coated roll of a calender is cleaned and/or ground and, in the method, damage of the hot spot type in the coating is detected and removed.

2. A method as claimed in claim 1, characterized in that, in the method, cleaning and grinding are carried out by the same unit.

3. A method as claimed in claim 1, characterized in that, in the method, the roll (10;41) is measured and conditioned by means of an assembly of devices (20).

4. A method as claimed in claim 3, characterized in that, in the method, the shape and the circularity of the roll are measured, and that the errors of shape and circularity of the roll noticed in the measurement are corrected by means of said assembly of devices (20).

5. A method as claimed in claim 3, characterized in that, in the method, in the control of the assembly of devices (20) that is used for measurement, cleaning/conditioning of the roll (10;41), measurement data received from the control system (34;54) of the paper machine/paper finishing device are taken into account.

6. A method as claimed in claim 3, characterized in that, in the method, any faults in the position of the roll, and faults in the roll (10) and in the frame constructions of the assembly of devices (20) are measured and compensated for.

7. A method as claimed in claim 3, characterized in that, in the method, the face of the roll (10;41) is measured by means of a member (47,49,50), which is included in the assembly of devices (20) and which is in contact with the face (42) of the roll (10;41) during the process, on which member (47,49,50) a displacement measurement detector (48) has been fitted, which transmits the changes, which are applied to the detector by the member (47,49,50) in contact with the face (42) of the roll and which changes arise from disturbance points (43) on the roll face (42), as a signal to the control system so as to start correcting operations by means of the assembly of devices (20).

8. A method as claimed in claim 7, characterized in that the contact point of the member (47) which is in contact with the roll face (42) consists of a face gliding against the face (42) or of a member rolling on said face, which face or member is constantly pressed against the face of the roll.

9. A method as claimed in claim 7, characterized in that the member (47) that is in contact with the roll face (42) and its detector (48) traverse in the axial direction of the roll while the member contacts the roll face (42) constantly.

10. A method as claimed in claim 7, characterized in that the condition of the roll face (42) is monitored by means of a number of detectors (48) placed side by side in the axial direction of the roll.

11. A method as claimed in claim 7, characterized in that, in the method, detectors (48) are used, which have been attached to a doctor or equivalent which is in constant contact with the roll face (42), and the number of said detectors can be one or several.

12. A method as claimed in claim 10, characterized in that the signals given by a number of detectors (48) placed side by side are processed, and the disturbances are located by measuring the delays and intensities of the signals arriving from different detectors and produced by vibrations.

13. A method as claimed in claim 9, characterized in that, as the detector (48), a vibration detector is used, by whose means vibrations produced by the face (42) of the roll are measured.

14. A device for conditioning of a roll in a paper machine and/or in a paper finishing device, which device (20) comprises:

traversing means for monitoring the condition of the face/coating on the roll and for cleaning and/or grinding the face/coating; and an assembly (20) of devices including:

a cleaning/grinding unit (24,34,41;23,29), a control unit (33), and measurement units (30,31,32;47,48,49,50), wherein the assembly (20) of devices operates continuously and operates during running and that the grinding pressure of the cleaning/grinding unit is arranged to be controlled based on measurement results obtained from the measurement units; and wherein the device is arranged to be used in conditioning of a polymer-coated roll in a calender in order to detect and remove damage of the hot-spot type in the coating.

15. A device as claimed in claim 14, characterized in that the cleaning/grinding unit is the same unit.

16. A device as claimed in claim 14, characterized in that the measurement unit comprises measurement members (30;48) for measurement of the cleanliness and the condition of the roll face.

17. A device as claimed in claim 14, characterized in that the measurement unit comprises a measurement unit (32) for measurement of the shape and the circularity of the roll.

18. A device as claimed in claim 14, characterized in that the measurement unit comprises a measurement device (31) for measurement of the position of the roll and for measurement of the roll (10) and of the position of the assembly of devices (20).

19. A device as claimed in claim 14, characterized in that the assembly of devices (20) comprises members for regulation of the grinding parameters.

20. A device as claimed in claim 14, characterized in that the assembly of devices comprises a contact member (47, 49,50), which has been fitted against the face (42) of the roll (41) that treats the product and on which contact member a displacement-measurement detector (48) has been fitted, a data transfer line (52) for transmitting the signal that is produced by the detector (48), and a recording unit (53), which has been connected to the data transfer line (52), in view of receiving and processing the signal.

21. A device as claimed in claim 14, characterized in that it comprises a traversing device, which has been arranged to transfer the contact member (47) substantially in the axial direction of the roll (41).

22. A device as claimed in claim 20, characterized in that several detectors (48) have been fitted side by side in the axial direction of the roll (41).

23. A device as claimed in claim 20, characterized in that the device comprises a control unit (54), which communicates with the roll face (42) correction device (56) and which has been arranged to control the correction device (56) on the basis of the data of the recording unit (53).

24. A device as claimed in claim 20, characterized in that the displacement-measurement detector (48) is a vibration detector.

* * * * *